US005381162A

United States Patent [19]

Roy et al.

[11] Patent Number: 5,381,162

[45] Date of Patent: * Jan. 10, 1995

[54] METHOD OF OPERATING AN INK JET TO REDUCE PRINT QUALITY DEGRADATION RESULTING FROM RECTIFIED DIFFUSION

[75] Inventors: Joy Roy; Douglas M. Stanley, both of Tigard; James D. Buehler, Gresham; Ronald L. Adams, Portland, all of Oreg.

[73] Assignee: Tektronix, Inc., Wilsonville, Oreg.

[ * ] Notice: The portion of the term of this patent subsequent to Oct. 13, 2009 has been disclaimed.

[21] Appl. No.: 958,989

[22] Filed: Oct. 8, 1992

Related U.S. Application Data

[63] Continuation of Ser. No. 665,615, Mar. 6, 1991, Pat. No. 5,155,498, which is a continuation-in-part of Ser. No. 553,498, Jul. 16, 1990.

[51] Int. Cl.[6] ..... B41V 2/045

[52] U.S. Cl. ..... 347/10; 347/68

[58] Field of Search ..... 346/1.1, 140 R

[56] References Cited

U.S. PATENT DOCUMENTS

| | | | |
|---|---|---|---|
| 4,387,383 | 4/1983 | Sayko | 346/140 R X |
| 4,393,384 | 7/1983 | Kyser | 346/140 R X |
| 4,490,731 | 12/1984 | Vaught | 346/140 R |
| 4,491,851 | 2/1985 | Mizuno et al. | 346/140 R X |
| 4,523,200 | 9/1985 | Howkins | 346/140 R X |
| 4,563,689 | 2/1986 | Murakami | 346/140 R X |
| 4,686,539 | 11/1987 | Schmidle et al. | 346/140 R X |
| 4,714,935 | 12/1987 | Yamamoto | 346/140 R |
| 4,730,197 | 8/1988 | Raman et al. | 346/140 R |
| 4,779,099 | 10/1988 | Lewis | 346/140 R X |
| 4,788,556 | 6/1988 | Hoisington et al. | 346/140 R X |
| 4,947,184 | 1/1990 | Moynihan | 346/140 R X |
| 4,961,082 | 4/1990 | Hoisington et al. | 346/140 R |
| 4,995,940 | 4/1991 | Hine et al. . | |
| 5,087,930 | 2/1992 | Roy | 346/140 R |
| 5,124,716 | 6/1992 | Roy | 346/140 R X |
| 5,170,177 | 12/1992 | Stanley | 346/140 R X |
| 5,182,572 | 1/1993 | Merritt | 346/140 R X |

OTHER PUBLICATIONS

"Deaeration System for a High-Peformance Drop-On-Demand Ink Jet," Nathan P. Hine, *Fifth International Congress on Advances in Non-Impact Printing Technologies*, pp. 567-576, (Nov. 1989).

"Introducing the SI480", Product Brochure of *Dataproducts*, (1986).

*Primary Examiner*—Joseph W. Hartary

*Attorney, Agent, or Firm*—Ralph D'Alessandro

[57] ABSTRACT

A drop-on-demand ink jet print head (9) has an ink pressure chamber (22) coupled to a source of ink (11) and an ink drop ejecting orifice (103) with an ink drop ejection orifice outlet (14). An acoustic driver (36), in response to a drive signal (100), produces a pressure wave in the ink and causes the ink to pass outwardly through the ink drop ejecting orifice (103) and the ink jet ejection orifice outlet (14) of the ink jet print head (9). In accordance with the present invention, controlling the operation of the ink jet print head (9) with a particular drive signal reduces print quality degradation resulting from rectified diffusion, which is the growth of .air bubbles dissolved in the ink from the repeated application of pressure pulses to the ink residing within the ink pressure chamber (22) of the ink jet print head (9), such pressure pulses causing the application of pressures below ambient pressure. This method of controlling the operation of the ink jet print head (9) applies pressure below ambient pressure to the ink residing within the ink pressure chamber (22) of the ink jet print head (9) at magnitudes less than the threshold pressure magnitude that leads to the air bubble growth.

32 Claims, 8 Drawing Sheets

METHOD OF OPERATING AN INK JET TO REDUCE PRINT QUALITY DEGRADATION RESULTING FROM RECTIFIED DIFFUSION

This is a continuation of U.S. patent application No. 07/665,615, filed Mar. 6, 1991, now U.S. Pat. No. 5,155,498, which in turn is a continuation-in-part of U.S. patent application No. 07/553,498, filed Jul. 16, 1990, for "Method of Operating an Ink Jet to Achieve High Print Quality and High Print Rate."

TECHNICAL FIELD

The present invention relates to the operation of ink jet print heads and, in particular, to a method for generating a drive signal to control the operation of ink jet print heads.

BACKGROUND OF THE INVENTION

The present invention relates to printing with a drop-on-demand ("DOD") ink jet print head wherein ink drops are generated utilizing a drive signal that controls the operation of the ink jet print head to reduce rectified diffusion. Rectified diffusion is the growth of air bubbles dissolved in the ink from the repeated application of pressure pulses, at pressures below ambient pressure, to ink residing within the ink pressure chamber of the ink jet print head. Rectified diffusion results in print quality degradation over time. By controlling the operation of the ink jet print head, the drive signal may also simultaneously reduce rectified diffusion and enhance the consistency of drop flight time from the ink jet print head to print media over a wide range of drop ejection or drop repetition rates.

Ink jet printers, and in particular DOD ink jet printers having ink jet print heads with acoustic drivers for ink drop formation, are well known in the art. The principle behind an ink jet print head of this type is the generation of a pressure wave in and the resultant subsequent emission of ink droplets from an ink pressure chamber through a nozzle orifice or ink drop ejection orifice outlet. A wide variety of acoustic drivers is employed in ink jet print heads of this type. For example, the drivers may consist of a pressure transducer formed by a piezoelectric ceramic material bonded to a thin diaphragm. In response to an applied voltage, the piezoelectric ceramic material deforms and causes the diaphragm to displace ink in the ink pressure chamber, which displacement results in a pressure wave and the flow of ink through one or more nozzles.

Piezoelectric ceramic drivers may be of any suitable shape such as circular, polygonal, cylindrical, and annular-cylindrical. In addition, piezoelectric ceramic drivers may be operated in various modes of deflection, such as in the bending mode, shear mode, and longitudinal mode. Other types of acoustic drivers for generating pressure waves in ink include heater-bubble source drivers (so-called bubble or thermal ink jet print heads) and electromagnet-solenoid drivers. In general, it is desirable in an ink jet print head to employ a geometry that permits multiple nozzles to be positioned in a densely packed array, with each nozzle being driven by an associated acoustic driver.

U.S. Pat. No. 4,523,200 to Howkins describes one approach to operating an ink jet print head with the purpose of achieving high velocity ink drops free of satellites and orifice puddling and providing stabilized ink jet print head operation. In this approach, an electromechanical transducer is coupled to an ink chamber and is driven by a composite signal including independent successive first and second electrical pulses of opposite polarity in one case and sometimes separated by a time delay. The first electrical pulse is an ejection pulse with a pulse width which is substantially greater than that of the second pulse. The illustrated second pulse in the case where the pulses are of opposite polarity has an exponentially decaying trailing edge. The application of the first pulse causes a rapid contraction of the ink chamber of the ink jet print head and initiates the ejection of an ink drop from the associated orifice. The application of the second pulse causes rapid expansion of the ink chamber and produces early break-off of an ink drop from the orifice. There is no suggestion in this reference of controlling the position of an ink meniscus before drop ejection; therefore, problems in printing uniformly at high drop repetition rates would be expected.

U.S. Pat. No. 4,563,689 to Murakami et al. discloses an approach for operating an ink jet print head with the purpose of achieving different size drops on print media. In this approach, a preceding pulse is applied to an electromechanical transducer prior to a main pulse. The preceding pulse is described as a voltage pulse that is applied to a piezoelectric transducer in order to oscillate ink in the nozzle. The energy contained in the voltage pulse is below the threshold necessary to eject a drop. The preceding pulse controls the position of the ink meniscus in the nozzle and thereby the ink drop size. In FIGS. 4 and 8 of Murakami et al., the preceding and main pulses are of the same polarity, but in FIGS. 9 and 11, these pulses are of opposite polarity. Murakami et al. also mentions that the typical delay time between the start of the preceding pulse to the start of the main pulse is on the order of 500 microseconds. Consequently, in this approach, drop ejection would be limited to relatively low repetition rates.

These prior art methods for operating ink jet print heads have difficulty achieving uniformly high print quality at high printing rates. Another potential problem associated with ink jet print heads is degradation in printing quality resulting from rectified diffusion. Rectified diffusion occurs when air bubbles dissolved in the ink grow from the repeated application of pressure waves or pulses, at pressures below ambient pressure, to ink residing within the ink pressure chamber of the ink jet print head. After a certain period of time, called the "onset-period," the printing quality degrades from continuously operating the ink jet print head in this manner. The onset-period depends on the drop repetition rate, and, prior to the initiation of continuous ink jet print head operation, on the amount of air dissolved in the ink, the ink viscosity, the ink density, the diffusivity of air in the ink, and the radii of the air bubbles dissolved in the ink. A need exists for a method of operating an ink jet print head that extends or eliminates the onset-period. A need also exists for a method that extends or eliminates the onset-period while simultaneously achieving high print quality at high printing rates.

SUMMARY OF THE INVENTION

An object of the present invention is, therefore, to provide a method to control the operation of a DOD ink jet print head so that it may continue printing for an indefinite or extended period of time with little or no print quality degradation resulting from rectified diffusion.

Another object of the present invention is to provide such a method to control the operation of the DOD ink jet print head so that it may print for a wide range of drop repetition rates, including high drop repetition rates.

Another object of this invention is to provide such a method so that the ink drops produced by controlling the operation of the ink jet print head have a substantially uniform travel time to reach the print medium.

The present invention constitutes a method to control the operation of a DOD ink jet print head to reduce print quality degradation resulting from rectified diffusion. The present invention also modifies the method of operating an ink jet print head recited in the parent patent application, of which this patent application is a continuation-in-part.

The parent patent application describes a method of operating a DOD ink jet print head ("ink jet print head") having an ink pressure chamber coupled to a source of ink and having an ink drop ejecting orifice ("orifice") with an ink drop ejection orifice outlet ("orifice outlet"). The orifice of the ink jet print head is coupled to the ink pressure chamber. An acoustic driver operates to expand and contract the volume of the ink pressure chamber to eject a drop of ink from the orifice outlet. The acoustic driver applies a pressure wave to the ink residing within the ink pressure chamber to cause the ink to pass outwardly through the orifice and through the orifice outlet. The acoustic driver may comprise a piezoelectric ceramic material driven by voltage signal pulses.

Upon application of a first voltage pulse, called the "refill pulse component," the acoustic driver operates to increase the volume of the ink pressure chamber through chamber expansion to refill the chamber with ink from the ink source. During ink pressure chamber expansion, ink is also drawn back within the orifice toward the ink pressure chamber and away from the orifice outlet. When the refill pulse component is no longer applied, a wait period state is then established during which time the ink pressure chamber returns to its original volume and the ink in the orifice advances within the orifice away from the ink pressure chamber and toward the orifice outlet. Upon application of a second voltage pulse of opposite relative polarity, called the "ejection pulse component," the acoustic driver then operates to reduce the volume of the ink pressure chamber through chamber contraction to eject a drop of ink. Thus, by applying these voltage pulses to the acoustic driver, a sequence of ink pressure chamber expansion, a wait period, and ink pressure chamber contraction accomplishes the ejection of ink drops.

In accordance with the invention described in the parent patent application, these steps are repeated at a high rate to achieve rapid printing. The refill pulse component, followed by the wait period state and the ejection pulse component comprise the drive signal. The refill pulse component and the ejection pulse component may be of square wave or trapezoidal wave form.

A preferred embodiment of the drive signal of the parent patent application comprises a bipolar electrical signal with refill and ejection pulse components varying about a zero amplitude reference voltage maintained during the wait period state; however, skilled persons would appreciate that the reference voltage need not have zero voltage amplitude. The drive signal may comprise pulse components of opposite relative polarity varying about a positive or negative reference voltage amplitude maintained during the wait period state. In accordance with the invention described in the parent patent application, the drive signal is also tuned to the characteristics of the ink jet print head to avoid the presence of high energy components at the dominant acoustic resonant frequency of the ink jet print head, which may be determined in a known manner. Typically, the most significant factor affecting the dominant resonant frequency of the ink jet print head is the resonant frequency of the ink meniscus. A significant factor affecting the dominant acoustic resonant frequency of the ink jet print head is the length of the passage from the outlet of the ink pressure chamber to the orifice outlet of the ink jet print head. This passage is called the "offset channel" in a preferred embodiment of the invention described by the parent patent application.

In accordance with the invention described in the parent patent application, the drive signal is tuned to the characteristics of the ink jet print head, preferably by adjusting the time duration of the wait period state and the time duration of the first or refill pulse component, including the rise time and fall time of the refill pulse component. The rise time and fall time for the refill pulse component is the transition time from zero voltage to the voltage amplitude of the refill pulse component and from the voltage amplitude of the refill pulse component to zero voltage, respectively. A standard spectrum analyzer may be used to determine the energy content of the drive signal at various frequencies. After a tuning adjustment, a minimum energy content of the drive signal coincides with the dominant acoustic resonant frequency of the ink jet print head.

The method of the present invention for operating an ink jet print head to reduce print quality degradation resulting from rectified diffusion is accomplished by modifying the pulse components of the drive signal so that the pressure applied to the ink residing within the ink pressure chamber of the ink jet print head, such pressure being below ambient pressure, is less than the threshold pressure magnitude that leads to rectified diffusion. One approach to accomplish this entails generating a drive signal to achieve high print quality and high printing rates in accordance with the parent patent application, as-described above. When this approach is followed, the pulse components of the drive signal are then modified to reduce print quality degradation resulting from rectified diffusion. To obtain the new drive signal from this initial drive signal, voltage amplitudes and time durations, including rise and fall times, of the refill and the ejection pulse components are, respectively, reduced and increased. Although the approach above begins with a drive signal to achieve high print quality and high printing rates in accordance with the parent patent application, any drive signal may be modified so that the pressure below ambient pressure applied to the ink residing within the ink jet print head is less than the threshold pressure magnitude that leads to rectified diffusion.

Where the initial drive signal achieves high print quality and high printing rates in accordance with the parent patent application, to control the operation of the ink jet print head to reduce print quality degradation resulting from rectified diffusion, the magnitude of the voltage of the refill pulse component is reduced by fifty percent, and the magnitude of the voltage of the ejection pulse component is reduced in relation to the newly established magnitude of the voltage of the refill pulse component. In a preferred form of the resulting drive signal, the magnitude of the voltage of the refill pulse component is less than 1.3 and greater than 1.15 of the magnitude of the voltage of the ejection pulse component. Furthermore, the relative polarities of the refill pulse component and the ejection pulse component may be reversed, depending upon the polarity of the pressure transducer.

For the initial drive signal generated in accordance with the parent patent application, the time durations of the refill pulse and the ejection pulse components, excluding rise and fall times, are then increased. In addition, the rise time and fall time for each of the refill and ejection pulse components are extended. The rise time and the fall time for each pulse component are the transition times, respectively, from zero voltage to the voltage amplitude of the pulse component and from the voltage amplitude to zero voltage. In a preferred form of the resulting drive signal, the rise and fall times for each of the refill and ejection pulse components are doubled.

The above described adjustments of the voltage amplitudes, time durations, excluding rise and fall times, and rise and fall times of each pulse component are performed so that the frequency spectrum of the preferred embodiment of the drive signal has a minimum energy content at the dominant acoustic resonant frequency of the ink jet print head.

Additional objects and advantages of the present invention will be apparent from the following detailed description of preferred embodiments thereof, which proceeds with reference to the accompanying drawings.

DETAILED DESCRIPTION OF PREFERRED EMBODIMENT

Figure 1:
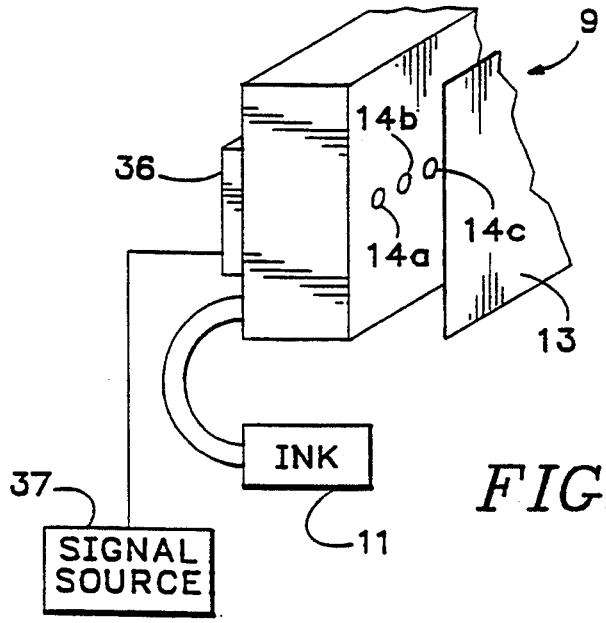
FIG. 1 is an illustration of one form of an ink jet print head with a print medium shown spaced from the ink jet print head.

With reference to FIG. 1, a DOD ink jet print head 9 is illustrated with an internal ink pressure chamber (not shown in this figure) coupled to an ink source 11. The ink jet print head 9 has one or more ink drop ejection orifice outlets ("orifice outlets") 14, of which outlets 14*a*, 14*b*, and 14*c* are shown, coupled to or in communication with the ink pressure chamber by way of an ink drop ejecting orifice ("orifice"). Ink passes through orifice outlets 14 during ink drop formation. Ink drops travel in a direction along a path from orifice outlets 14 toward a print medium 13, which is spaced from the orifice outlets. A typical ink jet printer includes a plurality of ink pressure chambers each coupled to one or more of the respective orifices and orifice outlets.

An acoustic drive mechanism 36 is utilized for generating a pressure wave or pulse, which is applied to the ink residing within the ink pressure chamber to cause the ink to pass outwardly through the orifice and its associated orifice outlet 14. The acoustic driver 36 operates in response to signals from a signal source 37 to cause the pressure waves applied to the ink.

The invention has particular applicability and benefits when piezoelectric ceramic drivers are used in ink drop formation. One preferred form of an ink jet print head using this type of acoustic driver is described in detail in U.S. Pat. No. 5,087,930 entitled "Drop-on-Demand Ink Jet Print Head," issued Feb. 11, 1992, Application to Joy Roy and John Moore. However, it is also possible to use other forms of ink jet printers and acoustic drivers in conjunction with the present invention. For example, electromagnet-solenoid drivers, as well as other shapes of piezoelectric ceramic drivers (e.g., circular, polygonal, cylindrical, and annular-cylindrical) may be used. In addition, various modes of deflection of piezoelectric ceramic drivers may also be used, such as bending mode, shear mode, and longitudinal mode.

Figure 3:
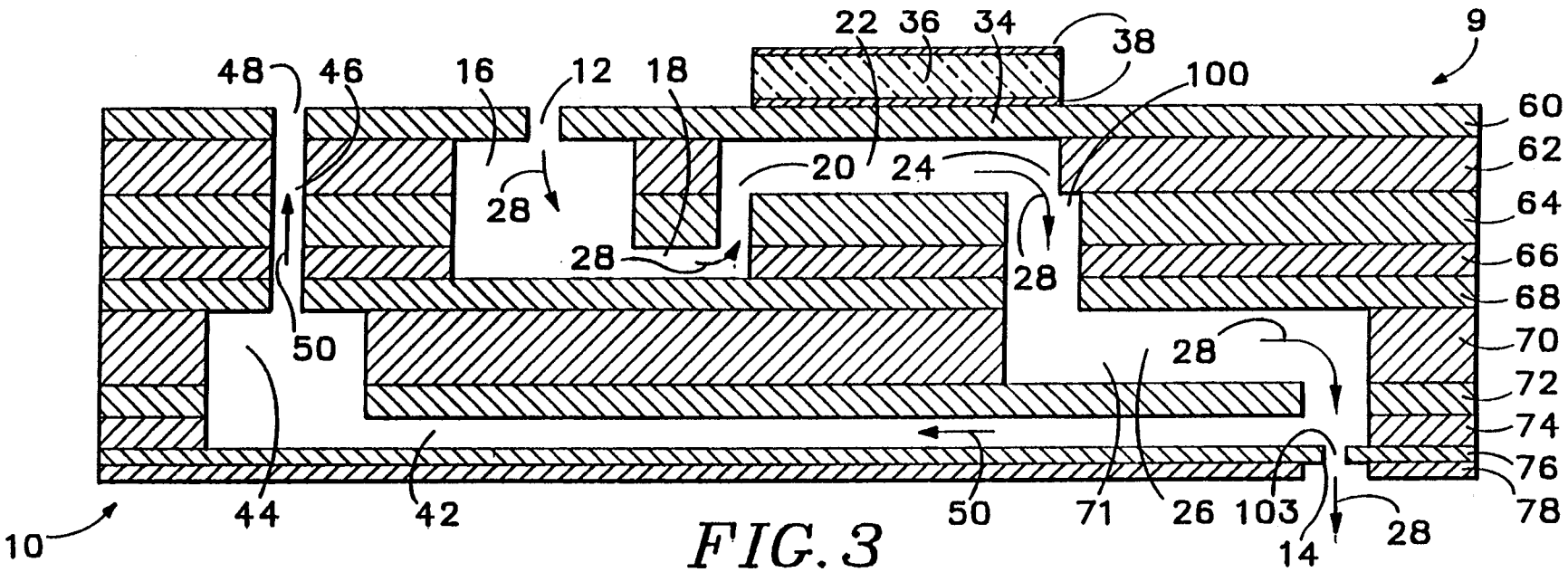
FIG. 3 is a schematic illustration, showing in cross section, of one type of ink jet print head capable of being operated in accordance with the method of the present invention.

With reference to FIG. 3, one form of ink jet print head 9 in accordance with the disclosure of the above-identified U.S. Pat. No. 5,087,930 has a body 10 which defines an ink inlet 12 through which ink is delivered to the ink jet print head. The body 10 also defines an orifice outlet or nozzle 14 together with an ink flow path 28 from the ink inlet 12 to the nozzle 14. In general, an ink jet print head of this type would preferably include an array of nozzles 14 which are proximately disposed, that is closely spaced from one another, for use in printing drops of ink onto a print medium.

Ink entering the ink inlet 12, e.g., from ink supply 11 as shown in FIG. 1, passes to an ink supply manifold 16. A typical color ink jet print head has at least four such manifolds for receiving, respectively, black, cyan, magenta, and yellow ink for use in black plus three color subtraction printing. However, the number of such ink supply manifolds may be varied depending upon whether a printer is designed to print solely in black ink or with less than a full range of color. From ink supply manifold 16, ink flows through an ink inlet channel 18, through an ink inlet 20 and into an ink pressure chamber 22. Ink leaves the ink pressure chamber 22 by way of an ink pressure chamber outlet 24 and flows through an ink passage 26 to the nozzle 14 from which ink drops are ejected. Arrows 28 diagram this ink flow path.

The ink pressure chamber 22 is bounded on one side by a flexible diaphragm 34. The pressure transducer, in this case a piezoelectric ceramic disc 36 secured to the diaphragm 34, as by epoxy, overlays the ink pressure chamber 22. In a conventional manner, the piezoelectric ceramic disc 36 has metal film layers 38 to which an electronic circuit driver, not shown in FIG. 3, but indicated at 37 in FIG. 1, is electrically connected. Although other forms of pressure transducers may be used, the illustrated transducer is operated in its bending mode. That is, when a voltage is applied across the piezoelectric ceramic disc, the disc attempts to change its dimensions. However, because it is securely and rigidly attached to the diaphragm 34, bending occurs. This bending displaces ink in the ink pressure chamber 22, causing the outward flow of ink through the ink passage 26 and to the nozzle 14. Refill of the ink pressure chamber 22 following the ejection of an ink drop can be augmented by reverse bending of the pressure transducer 36.

In addition to the ink flow path 28 described above, an optional ink outlet or purging channel 42 is also defined by the body 10 of ink jet print head 9. The purging channel 42 is coupled to the ink passage 26 at a location adjacent to, but interior to, the nozzle 14. The purging channel 42 communicates from ink passage 26 to an outlet or purging manifold 44 which is connected by a purging outlet passage 46 to a purging outlet port 48. The purging manifold 44 is typically connected by similar purging channels 42 to similar ink passages 26 associated with multiple nozzles 14. During a purging operation, ink flows in a direction indicated by arrows 50, through purging channel 42, purging manifold 44, purging outlet passage 46 and to the purging outlet port 48.

Exemplary dimensions for elements of the ink jet print head of FIG. 3 are set forth in Table 1 below.

TABLE 1

Representative Dimensions and Resonant Characteristics For FIG. 3 Ink Jet Print Heads

| Feature | Cross Section | Length | Frequency of Resonance |
|---|---|---|---|
| Ink Supply Channel 18 | 008" × 0.010" | 0.268" | 60-70 KHz |
| Diaphragm Plate 60 | 0.110" dia. | 0.004" | 160-180 KHz |
| Body Chamber 22 | 0.110" dia. | 0.018" | |

TABLE 1-continued

Representative Dimensions and Resonant Characteristics For FIG. 3 Ink Jet Print Heads

| Feature | Cross Section | Length | Frequency of Resonance |
|---|---|---|---|
| Separator Plate 64 | 0.040" × 0.036" | 0.022" | |
| Offset Channel 71 | 0.020" × 0.036" | 0.116" | 65-85 KHz |
| Purging Channel 42 | 0.004" × 0.010" | 0.350" | 50-55 KHz |
| Orifice Outlet 14 | 50-70 μm | 60-76-μm | 13-18 KHz |

Figure 2:
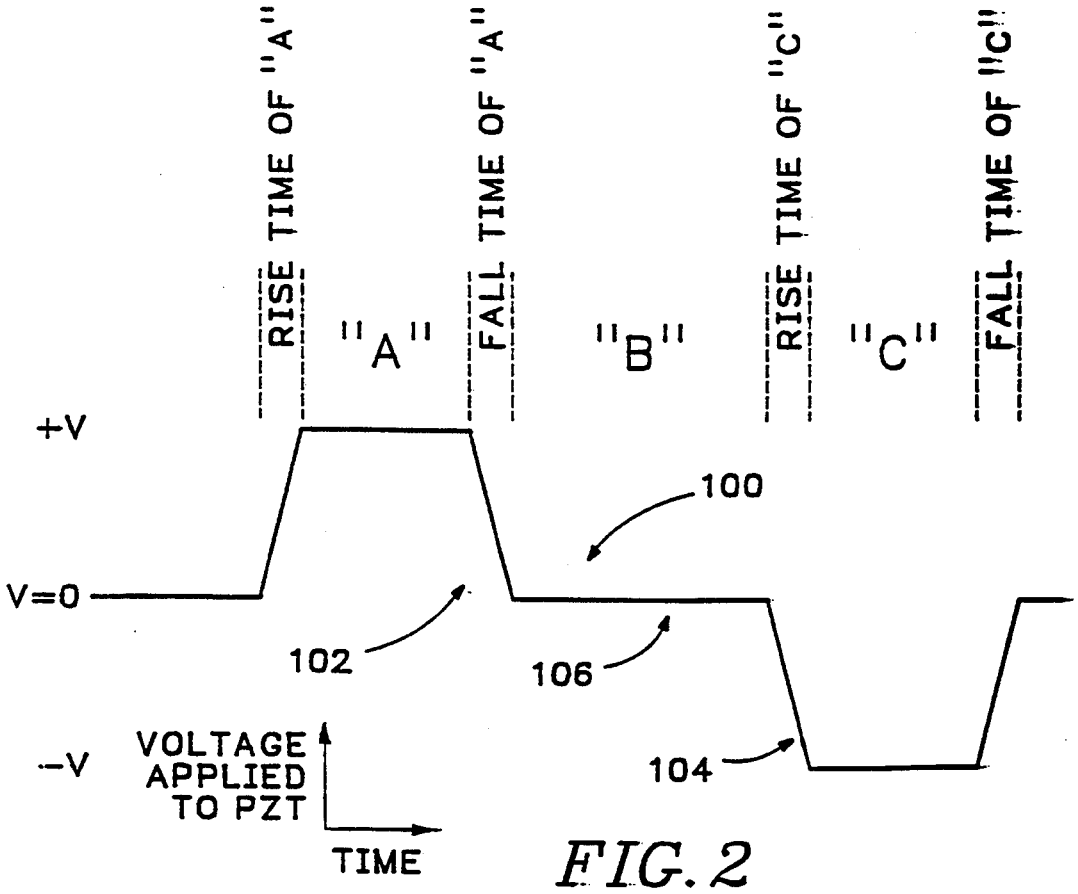
FIG. 2 illustrates one form of drive signal for an acoustic driver of an ink jet print head.

One form of drive signal for controlling the operation of ink jet print heads utilizing acoustic drivers to achieve high print quality and high printing rates is illustrated in FIG. 2. This particular drive signal is a bipolar electrical pulse 100 with a refill pulse component 102 and an ejection pulse component 104. The components 102 and 104 are voltages of opposite relative polarity of possibly different voltage amplitudes. These electrical pulses or pulse components 102, 104 are also separated by a wait period state indicated by 106. The time duration of the wait period 106 is indicated as "B" in FIG. 2. The relative polarities of the pulse components 102, 104 may be reversed from that shown in FIG. 2, depending upon the polarization of the piezoelectric ceramic driver mechanism 36 (FIG. 1). FIG. 2 demonstrates the representative shape of the drive signal, but does not provide representative values for the various attributes of the signal or its pulse components, such as voltage amplitudes, time durations or rise times and fall times. Furthermore, although the pulse components of the drive signal shown in FIG. 2 have trapezoidal or square wave form, in actual operation these pulse components may exhibit exponentially rising leading edges and exponentially decaying trailing edges.

A preferred embodiment of the drive signal comprises a bipolar electrical signal with refill and ejection pulse components varying about a zero voltage amplitude maintained during the wait period 106; however, neither the claimed invention nor the invention claimed by the parent patent application is limited to this particular embodiment. The drive signal may comprise pulse components of opposite relative polarity varying about a positive or negative reference voltage amplitude maintained during the wait period state.

In the operation of an ink jet print head, utilizing the drive signal described above, the ink pressure chamber 22 expands upon the application of the refill pulse component 102 and draws ink into the ink pressure chamber 22 from the ink source 11 to refill the ink pressure chamber 22 following the ejection of a drop. As the voltage falls toward zero at the end of the refill pulse component 102, the ink pressure chamber 22 begins to contract and moves the ink meniscus forward in the ink orifice 103 (FIG. 3) toward the orifice outlet 14. During the wait period "B" the ink meniscus continues toward the orifice outlet 14. Upon the application of the ejection pulse component 104, the ink pressure chamber 22 is rapidly constricted to cause the ejection of a drop of ink. After the ejection of the drop of ink, the ink meniscus is once again drawn back into the ink orifice 103 away from the orifice outlet 14 as a result of the application of the refill pulse component 102. The time duration of the refill pulse component, including rise and fall times, is less than the time required for the ink meniscus to return to a position adjacent to the orifice outlet 14 for ejection of a drop of ink.

Typically, the time duration of the refill pulse component 102, including rise time and fall time, is less than one-half of the time period associated with the resonant frequency of the ink meniscus. More preferably, this duration is less than about one-fifth of the time period associated with the resonant frequency of the ink meniscus. The resonant frequency of an ink meniscus in an orifice of an ink jet print head can be easily calculated from the properties of the ink, including the volume of the ink inside the ink jet print head, and the dimensions of the orifice in a known manner.

As the time duration of the wait period "B" increases, the ink meniscus moves closer to the orifice outlet 14 at the time the ejection pulse component 104 is applied. In general, the time duration of the wait period 106 and of the ejection pulse component 104, including the rise time and fall time of the ejection pulse component, is less than about one-half of the time period associated with the resonant frequency of the ink meniscus. For controlling the operation of an ink jet print head to achieve high print quality and high printing rates by the drive signal described, typical time periods associated with the resonant frequency of the ink meniscus range from about 50 microseconds to about 160 microseconds, depending upon the configuration of the specific ink jet print head and the particular ink.

The pulse components 102 and 104 of the drive signal controlling the operation of the ink jet print head to achieve high print quality and high printing rates are shown in FIG. 2 as being generally trapezoidal and of opposite polarity. Square wave pulse components may also be used. A conventional signal source 37 may be used to generate pulses of this shape. Other pulse shapes may also be used. In general, a suitable refill pulse component 102 is one which results in increasing the volume of the ink pressure chamber 22 through the expansion of the chamber to refill the chamber with ink from the ink source 11 while withdrawing the ink in the ink orifice 103 back toward the ink pressure chamber 22 and away from the orifice outlet 14. The wait period 106 is a period during which essentially zero voltage is applied to the acoustic driver. It comprises a period during which the ink pressure chamber 22 is allowed to return back to its original volume due to contraction of the chamber so as to allow the ink meniscus in the ink orifice 103 to advance within the orifice away from the ink pressure chamber 22 and toward the orifice outlet 14. The ejection pulse component 104 is of a shape which causes a rapid contraction of the ink pressure chamber 22 following the wait period 106 to reduce the volume of the chamber and eject a drop of ink.

A drive signal composed of pulses of the form shown in FIG. 2 is repeatedly applied to cause the ejection of ink drops. One or more pulses may be applied to cause the formation of each drop, but, in a preferred embodiment, at least one such composite drive signal is used to form each of the drops. In addition, the time duration of the wait period 106 is typically set to allow the ink meniscus in the ink orifice 103 to advance to substantially the same position within the orifice during each wait period before contraction of the ink pressure chamber 22 to eject a drop. It is preferable that the ink meniscus have a remnant of forward velocity within ink orifice 103 toward orifice outlet 14 at the time of arrival of the pressure pulse in response to the ejection pulse component 104 of FIG. 2. Under these conditions, the fluid column propelled out of the ink jet print head properly coalesces into a drop to thereby minimize the formation of Satellite drops. The ink meniscus should not advance to a position beyond the orifice outlet 14. If ink is allowed to project beyond the orifice outlet 14 for a substantial period of time before the ejection pulse 104 is applied, it may wet the surface surrounding the orifice outlet. This wetting may cause an asymmetric deflection of ink drops and non-uniform drop formation as the various drops are formed and ejected. By positioning the ink meniscus at substantially the same position prior to the pressure pulse, uniformity of drop flight time to the print medium is enhanced over a wide range of drop ejection rates.

Exemplary durations of the various pulse components for achieving high print quality and high printing rates are 5 microseconds for the "A" portion of the refill pulse component 102, with rise and fall times of respectively 1 microsecond and 3 microseconds; a wait period "B" of 15 microseconds; and an ejection pulse component 104 with a "C" portion of 5 microseconds and with rise and fall times like those of the refill pulse component 102. As stated earlier, FIG. 2 demonstrates the representative shape of the drive signal, but does not provide representative values for its various attributes. To achieve high print quality and high printing rates, it may sometimes be advantageous to reduce the duration of these time periods so that the fluidic system may be reinitialized as quickly as possible, thereby making faster printing rates possible. However, this ignores the print quality degradation resulting from rectified diffusion that reducing the duration of these time periods may cause or further degrade. An alternative method to increase the drop repetition rate for the drive signal comprises reducing the time duration from the trailing edge of the ejection pulse component to the leading edge of the refill pulse component. This method has the advantage that it does not affect the time durations of the pulse components, including rise and fall times.

Figure 4A:
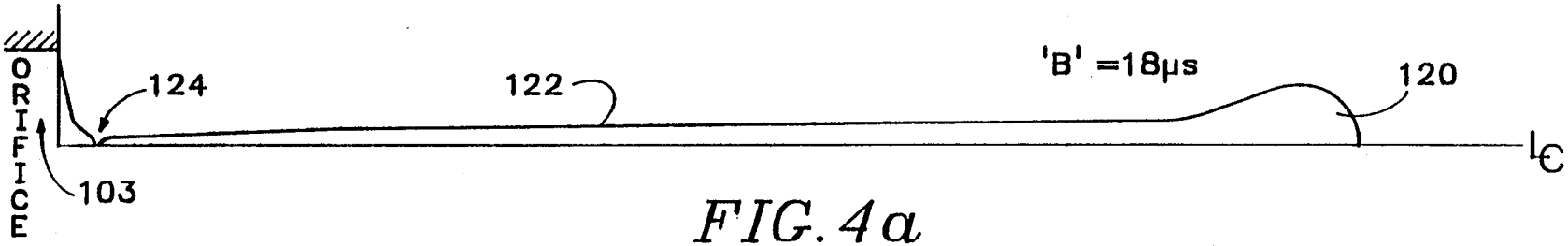
FIGS. 4*a*, 4*b*, and 4*c*, for various wait periods, illustrate a simulation of the change in shape of an ejected ink column at a point near breakoff of an ink drop from the column when an ink jet print head of the type illustrated in FIG. 3 is actuated by a single drive signal of the type shown FIG. 2.
Figure 4B:
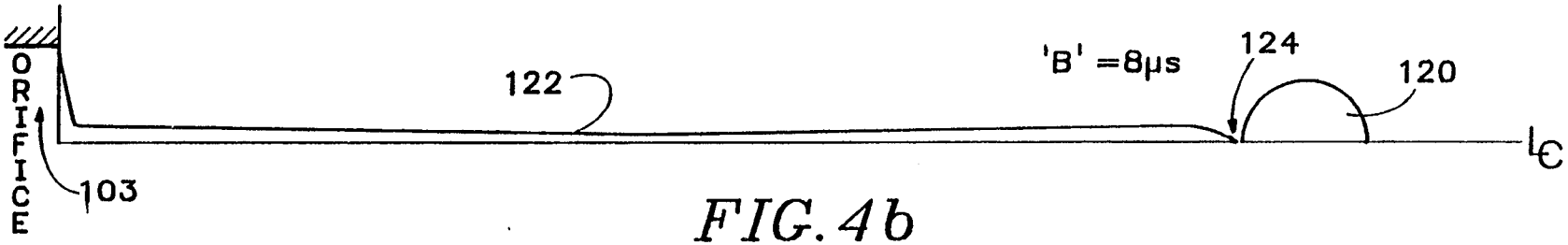
Figure 4C:
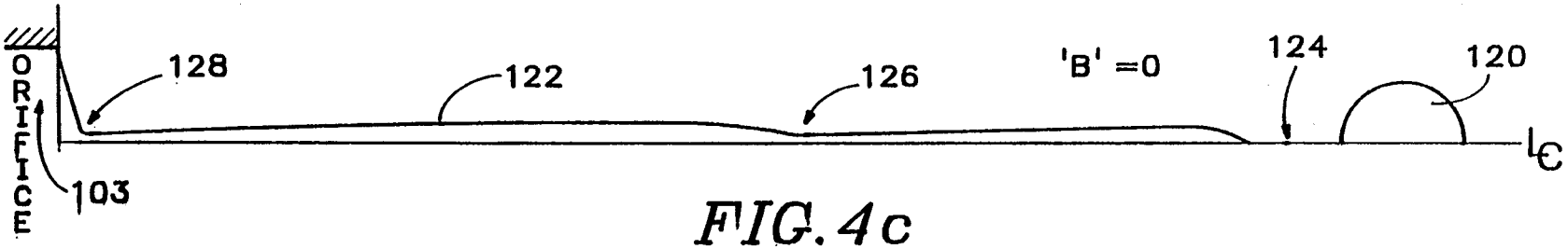

FIG. 4 illustrates a simulation of the change in shape of an ejected ink column when an ink jet print head of the type illustrated in FIG. 3 is actuated by a drive signal composed of the exemplary durations above. FIGS. 4*a*, 4*b*, and 4*c* demonstrate the effect of varying the wait period 106. As shown in FIG. 4*a*, with the time duration of the wait period "B" at 18 microseconds, the main volume of ink 120 forms a spherical head which is connected to a long tapering tail 122 with drop breakoff occurring at a location 124 between the tail of this filament and the orifice outlet 14. After drop breakoff the tail 122 starts to coalesce into the head 120 and does not form a spherical drop by the time it reaches the print medium. However, due to the relatively high speed of the ink column with respect to the print medium the resulting spot on the print medium is nearly spherical.

As shown in FIG. 4*b*, with a wait period 106 of 8 microseconds, the drop breakoff point 124 is adjacent to the main volume of ink 120 and results in a cleanly formed drop. In this case, the tail 122 of the drop breaks off subsequently to the orifice outlet 14 and forms a satellite drop which moves at a relatively smaller velocity than that of the main drop. Consequently, the main drop 120 and satellite drop 122 form two separate spots on the print medium.

With reference to FIG. 4*c*, and with a wait period 106 of zero microseconds, the drop breakoff point 124 occurs adjacent to the main drop volume 120. However, the remaining ink filament 122 has weak points, indicated at 126 and 128, corresponding to potential locations at which the filament may break off and form satellite drops.

The FIG. 4 illustrations are the result of a theoretical model of the operation of the ink jet print head of FIG. 3 using the form of the drive signal shown in FIG. 2. The FIG. 4 illustrations show only the upper half of the formed drop above the center line of the ink orifice 103 in each of these figures.

The inclusion of a refill pulse component 102 in the drive signal tends to draw ink back from the external surface surrounding the orifice outlet 14. This action minimizes the possibility of ink wetting the surface surrounding the outlet and distorting the travel or breakoff of ink drops at the orifice outlet. The preferred time duration of the wait period "B" is a combined function of the time for the retracted ink meniscus in ink orifice 103 to reach the orifice outlet 14 and the velocity of the ink at the instant of arrival of the pressure pulse initiated by the ejection pulse component 104. It is desired that the retracted ink meniscus reach the orifice outlet 14 with waning velocity just before the pressure pulse from the ejection pulse component 104 is applied.

Figure 5:
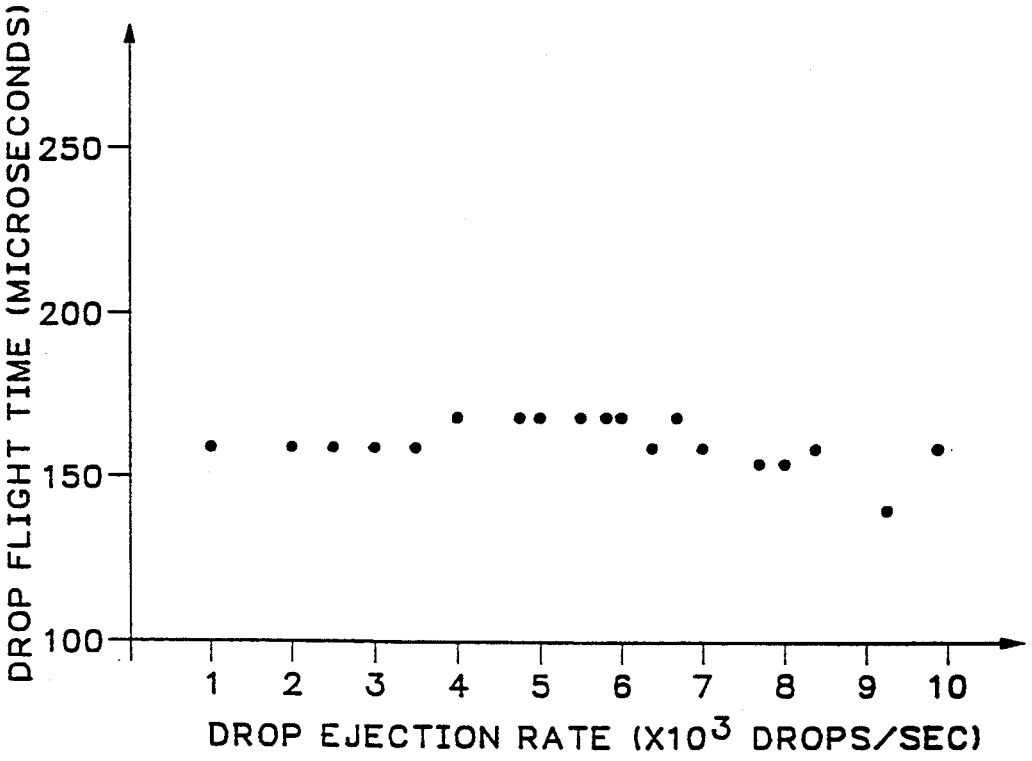
FIG. 5 is a plot of drop flight time versus drop ejection rate for the continuous operation of an ink jet print head of the type illustrated in FIG. 3 when actuated by a drive signal of the type shown in FIG. 2, where the time duration of the ejection pulse component, including rise and fall times, has been adjusted so that the minimum energy content of the drive signal coincides with the dominant acoustic resonant frequency of the ink jet print head.

FIG. 5 depicts the situation in which the ink jet print head is operated in the manner described to achieve high print quality and high printing rates. FIG. 5 is a plot of the drop flight time for an ink jet print head of the type shown in FIG. 3 versus drop ejection rate and is substantially constant over a range of drop ejection rates through and including ten thousand drops per second. In this FIG. 5 example, the print medium was 1 mm from the ink jet print head orifice outlet 14, and drop speeds in excess of 6 meters per second were achieved. As also shown in FIG. 5, a maximum deviation of 30 microseconds was observed over an ink jet drop ejection rate ranging from 1,000 drops per second to 10,000 drops per second. In addition, at below 8,500 drops per second, this deviation was much less pronounced. Thus, by suitably selecting a drive signal having a refill pulse component 102, a wait period 106, and an ejection pulse component 104, substantially constant drop flight times can be achieved over a wide range of drop ejection rates. Substantially constant drop flight times result in high print quality.

In addition, the drop speeds are relatively fast with uniform drop sizes being available. The drop trajectories are substantially perpendicular to the orifice face plate for all drop ejection rates, inasmuch as the refill pulse component 102 of the drive signal assists in reducing wetting of the external surface surrounding the orifice outlet 14 which may cause a deflection of the ejected drops from a desired trajectory. Moreover, satellite drop formation is minimized because this drive signal allows high viscosity ink, such as hot melt ink, within the conduit of the ink orifice 103 to behave as an intracavity acoustic absorber of pressure pulses reverberating in the offset channel 71 of an ink jet print head of the type shown in FIG. 3. The relatively simple drive signal of the type illustrated in FIG. 2 may be achieved with conventional off-the-shelf digital electronic drive signal sources.

A preferred relationship between the drive pulse components 102, 104, and 106, has been experimentally determined for achieving high print quality and high printing rates and is disclosed in the parent patent application. These preferred relationships, however, while achieving high print quality and high printing rates, ignore the potential effect on print quality degradation resulting from rectified diffusion. For an ink jet print head, such as of the type shown in FIG. 3, by establishing a wait period 106 of at least as great as and preferably greater than about 8 microseconds, uniform and consistent ink drop formation has been achieved. Shorter wait periods have been observed in some cases to increase the probability of formation of satellite drops. Preferably the time duration of the refill or expanding pulse component 102, including rise time and fall time, is no more than about 16 to 20 microseconds. A greater refill pulse component time duration increases the possibility of ingesting bubbles into the orifice outlet 14. To achieve high print quality and high printing rates, the refill pulse component time duration, including rise time and fall time, need be no longer than necessary to replace the ink ejected during ink drop formation. Shorter refill pulse component time durations increase the drop repetition rate which may be achieved. However, as indicated, this ignores the effect that these shorter refill pulse component time durations may have upon print quality degradation resulting from rectified diffusion. In general, the refill pulse component 102 has a time duration, including rise time and fall time, to achieve high print quality and high printing rates of no less than about 7 microseconds. The time duration of the ejection pulse component 104, including rise time and fall time, to achieve high print quality and high printing rates is typically no more than about 16 to 20 microseconds and no less than about 6 microseconds.

Within these drive signal parameters that control the operation of an ink jet print head to achieve high print quality and high printing rates, ink jet print heads of the type shown in FIG. 3 have been operated at drop ejection rates through and including 10,000 drops per second, and higher, and at drop ejection speeds in excess of 6 meters per second. The drop speed nonuniformity has been observed at less than 15 percent over continuous and intermittent drop ejection conditions. As a result, the drop position error is much less than one-third of a pixel at 11.81 drops per mm printing with an 8 kilohertz maximum printing rate. In addition, a measured drop volume of 170 picoliters of ink per drop$\pm$15 picoliters (over the entire operating range of 1,000 to 10,000 drops per second) has been observed and is suitable for printing at 11.81 drops per mm addressability when using hot melt inks. Additionally, minimal or no satellite droplets occur under these conditions.

As shown in FIG. 2, the first pulse component, refill component 102, reaches a voltage amplitude and is maintained at this amplitude for a period of time prior to termination of the first or refill pulse component. In addition, the second or ejection pulse component 104 reaches a negative voltage amplitude and is maintained at this amplitude for a period of time prior to termination of the second pulse. Although this may be varied, in the illustrated form to achieve high print quality and high printing rates, these drive pulse components are trapezoidal in shape and have a different rise time to their respective voltage amplitudes from the fall time from their respective voltage amplitudes. In a drive signal to achieve high print quality and high printing rates as disclosed in the parent patent application, the two pulse components 102, 104 have rise times from about one microsecond to about 4 microseconds, maintain their respective voltage amplitudes from about 2 microseconds to about 7 microseconds, with the wait period 106 being greater than about 8 microseconds. In an alternative drive signal to achieve high print quality and high printing rates, the rise time of the first pulse is about 2 microseconds, the first pulse achieves its voltage amplitude from about 3 microseconds to about 7 microseconds, the first pulse has a fall time from about 2 microseconds to about 4 microseconds, and the wait period 106 is from about 15 microseconds to about 22 microseconds. In addition, in this case the ejection pulse component 104 is like the refill pulse component 102, except of opposite relative polarity.

It should be noted that to achieve high print quality at high printing rates these time durations may be varied for different ink jet print head designs and different inks. Again, it is desirable for the ink meniscus to be traveling forward and to be at a common location at the occurrence of each pressure wave resulting from the application of the ejection pulse component 104. The parameters of the drive signal may be varied to achieve these conditions.

It has also been discovered that optimal print quality and printing rate performance is achieved when the drive signal is shaped so as to provide a minimum energy content at the dominant acoustic resonant frequency of the ink jet print head. That is, the dominant acoustic resonant frequency of the ink jet print head can be determined in a well-known manner. The dominant resonant frequency of the ink jet print head typically corresponds to the resonant frequency of the ink meniscus. When an ink jet print head of the type shown in FIG. 3 is used with an offset channel 71, the dominant acoustic resonant frequency in general corresponds to the standing wave resonant frequency through the liquid ink in the offset channel. By using a drive signal with an energy content which is at a minimum at the dominant acoustic resonant frequency of the ink jet print head, reverberations at this dominant acoustic resonant frequency are minimized, such reverberations otherwise potentially interfering with the uniformity of flight time of drops from the ink jet print head to the print medium.

In general, to assist in adjusting the drive signal to achieve high print quality and high printing rates, a Fourier transform or spectral analysis is performed of the complete drive signal. The complete drive signal is an entire set of pulses used in the formation of a single ink drop. In the case of a drive signal of the-type shown in FIG. 2, the complete signal includes the refill pulse component 102, the wait period 106, and the ejection pulse component 104. A conventional spectrum analyzer may be used in determining the energy content of the drive signal at various frequencies. This energy content will vary with frequency from highs or peaks to valleys or low points. A minimum energy content portion of the drive signal at certain frequencies is substantially less than the peak energy content at other frequencies. For example, a minimum energy content may be at least about 20 dB below the maximum energy content of the drive signal at other frequencies.

The drive signal may be adjusted to shift the frequency of this minimum energy content to be substantially equal to the dominant acoustic resonant frequency of the ink jet print head. With the drive signal adjusted in this manner, the energy of the drive signal at the dominant acoustic resonant frequency is minimized. As a result, the effect of resonant frequencies of the ink jet print head on ink drop formation is minimized. Although not limited to any specific approach, a preferred method of adjusting the drive signal to achieve high print quality and high printing rates comprises the step of adjusting the time duration of the first pulse, or refill pulse component 102, including rise time and fall time, and of the wait period 106. These pulse components are adjusted in duration until there is a minimum energy content of the drive signal at the frequency which is substantially equal to the dominant acoustic resonant frequency of the ink jet print head.

Continuously operating an ink jet print head for a long period of time may lead to print quality degradation resulting from rectified diffusion, particularly when such operation occurs at high drop repetition rates. Rectified diffusion is the growth of air bubbles dissolved in the ink caused by the repeated application of pressure pulses, at pressures below ambient pressure, to the ink residing within the ink pressure chamber of the ink jet print head. When the ink jet print head operates in the open atmosphere the ambient pressure generally corresponds to atmospheric pressure. Air bubble growth will result from the application of pressures below atmospheric pressure to the ink residing within the ink pressure chamber of the ink jet print head, as described. The parent patent application provides one example of operation of an ink jet print head at rapid drop repetition rates. An aspect of the present invention reduces print quality degradation resulting from rectified diffusion. A preferred embodiment may simultaneously achieve uniformly high print quality at high printing rates.

The period of time necessary for the onset of print quality degradation, called the onset-period, depends on the drop repetition rate and, prior to the initiation of continuous operation of the ink jet print head, on the amount of air dissolved in the ink, the ink viscosity, the ink density, the diffusivity of the air in the ink, and the radii of the air bubbles dissolved in the ink. Air bubble growth results when, for pressures below ambient pressure, pressure pulse magnitudes occur above a threshold pressure magnitude at a drop repetition rate above a threshold drop repetition rate. With ink having an amount of dissolved air well below the saturation level of the ink for dissolved air, it will typically take 10 minutes of continuous operation of the ink jet print head at a drop repetition rate of 8 kilohertz before the impairment of ink drop ejection and the associated print quality degradation. For ink saturated with dissolved air, it will typically take only 30 seconds at the same drop repetition rate for print quality degradation to occur.

The present invention inhibits air bubble growth in DOD ink jet print heads by controlling the operation of the ink jet print head with a drive signal that, for pressures below ambient pressure, applies pressure to the ink at magnitudes less than the threshold pressure magnitude that leads to the air bubble growth. In a preferred embodiment, a drive signal that achieves high print quality .at high printing rates in accordance with the parent patent application is modified in accordance with the present invention so that the resulting drive signal simultaneously achieves uniformly high print quality for a wide range of drop ejection rates, including high rates.

The resulting drive signal applies pressure below ambient pressure to the ink residing within the ink pressure chamber of the ink jet print head at magnitudes less than the threshold pressure magnitude that leads to rectified diffusion, while simultaneously achieving high print quality at high printing rates. Nonetheless, other embodiments of the present invention may reduce print quality degradation resulting from recitified diffusion without achieving high print quality at high printing rates in accordance with the parent patent application. For example, the present invention is not limited to a bipolar drive signal; however, to accomplish the preferred embodiment, one may obtain a drive signal to control the operation of an ink jet print head by the method previously described, and make modifications to this drive signal that will result in the application of lower pressure magnitudes, at pressures below ambient pressure, to the ink residing within the ink pressure chamber of the ink jet print head. Although the preferred embodiment involves modifications to both the refill pulse component and the ejection pulse component, other embodiments of the present invention may only modify one of these pulse components. In the modified drive signal, the refill pulse component and the ejection pulse component have greater time durations, excluding rise and fall times, at their respective voltage amplitudes. In addition, the rise times and the fall times of the refill pulse component and the ejection pulse component of the modified drive signal are extended. This avoids inducing large pressure pulses below ambient pressure that occur in the ink pressure chamber with rapid changes in the voltage amplitude applied to the acoustic driver of the ink jet print head. In the preferred embodiment both the rise time and the fall time of the pulse components are extended; however, extending at least one of these times will also reduce print quality degradation resulting from rectified diffusion. The respective voltages of the refill pulse component and the ejection pulse component are also reduced in magnitude. Furthermore, the magnitude of the voltage of the refill pulse component is reduced with respect to the magnitude of the voltage of the ejection pulse component to obtain the modified drive signal.

Reducing the voltage amplitude of the refill pulse component relative to that of the ejection pulse component will reduce the magnitude of the pressures below ambient pressure applied to the ink residing within the ink pressure chamber of the ink jet print head; however, where the ink jet print head operates at high drop repetition rates, such voltage amplitude reduction may result in another problem also associated with prolonged operation of an ink jet print head.

At high drop repetition rates the ink jet print head operates at high ink flow rates. During such operation, the refill pulse component serves various purposes, including providing adequate refill of the ink pressure chamber by overcoming the flow resistances present primarily through the inlet channel of the ink jet print head. The refill pulse component serves this purpose at low repetition rates as well; however, the ink flow resistances become more pronounced at high drop repetition rates due to the associated high ink flow rates. These flow resistances also become stronger in an ink jet print head array where several ink jet print heads are supplied ink through a common conduit. If all the ink jet print heads sharing the conduit are simultaneously operating at a high drop repetition rate the associated flow resistance may become significant. In such a situation, after prolonged operation, the ink jet print head array exhibits decreasing ink flow over time and the ink pressure chamber does not adequately refill. Ultimately, one or more ink jet print heads stop ejecting ink altogether and reach a state called "starvation."

One way to avoid "starvation" and provide adequate refill of the ink pressure chamber involves increasing the voltage amplitude of the refill pulse component relative to the voltage amplitude of the ejection pulse component. Thus, a potential trade-off exists between (1) lowering the relative voltage amplitude of the refill pulse component to reduce rectified diffusion by lowering the magnitude of the pressures below ambient pressure applied to the ink residing in the ink pressure chamber and (2) raising the relative voltage amplitude of the refill pulse component to avoid starvation. The preferred operating range of the ink jet print head regarding these relative voltage amplitudes may be characterized mathematically at the ratio of the magnitude of the voltage of the refill pulse component to the magnitude of the voltage of the ejection pulse component. This ratio is termed the "aspect ratio." The preferred embodiment of the present invention to ensure prolonged operation of an ink jet print head array at high drop repetition rates has an aspect ratio between 1.15 and 1.3. Other embodiments may provide prolonged operation for aspect ratios between 1.0 and 1.4.

Controlling the operation of an ink jet print head by the modified drive signal described above will result in high print quality at high printing rates as previously described while simultaneously reducing print quality degradation resulting from rectified diffusion. For example, the drive signal illustrated in FIG. 6 achieves high print quality while actuating an ink jet print head of .the type illustrated in FIG. 3 at 10 kilohertz. The drive signal illustrated in FIG. 7 achieves high print quality and reduces print quality degradation from rectified diffusion by actuating an ink jet print head of the type illustrated in FIG. 3 at 8 kilohertz.

Figure 6:
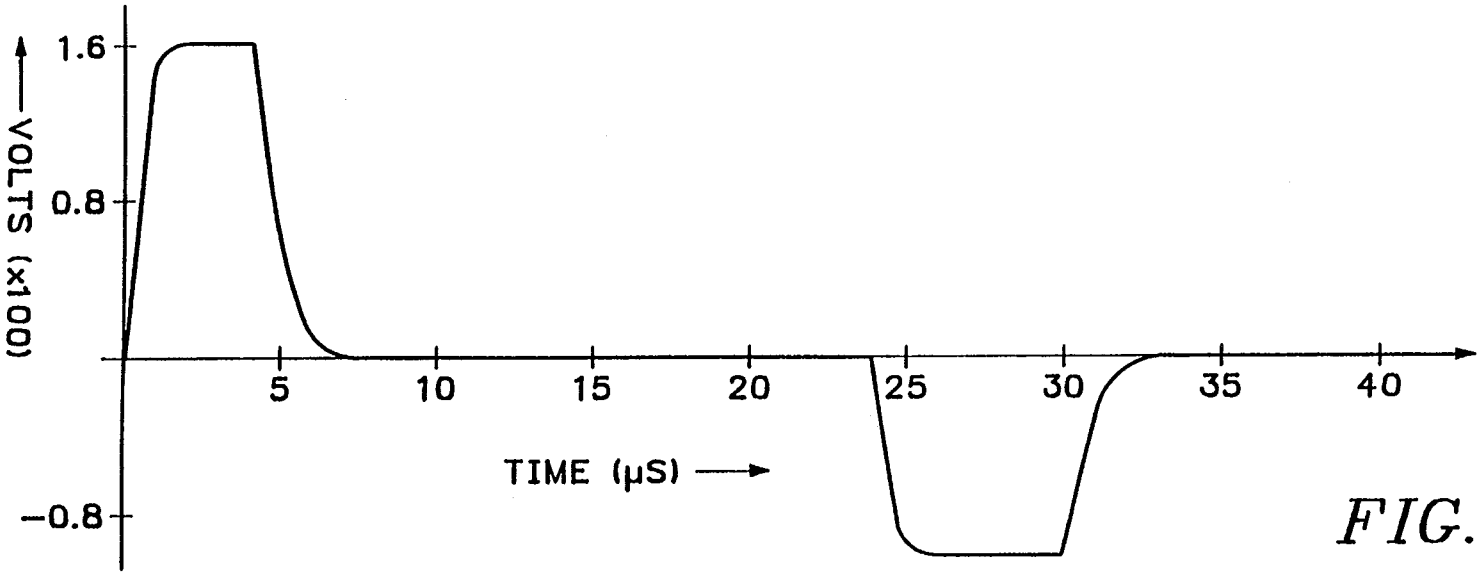
FIG. 6 illustrates another form of drive signal for an acoustic driver of an ink jet print head of the type shown in FIG. 3, with values provided for the time durations of the refill and ejection pulse components, including rise and fall times, the time duration of the wait period, and the voltage amplitudes of the refill and ejection pulse components.

FIG. 6 shows a drive signal of the type illustrated in FIG. 2 for an acoustic driver of a specific ink jet print head. It provides values for the time durations at the respective voltage amplitudes of the refill pulse component and the ejection pulse component, for the time duration of the wait period, and for the respective voltage amplitudes of the refill pulse component and the ejection pulse component. It also provides rise and fall times for the pulse components.

Figure 7:
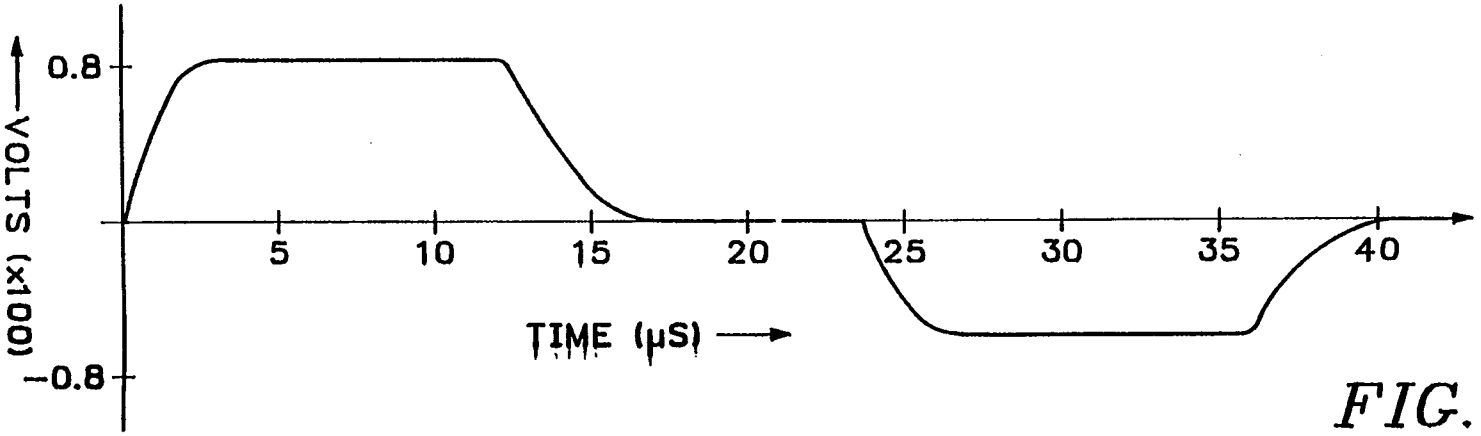
FIG. 7 illustrates a drive signal for reducing rectified diffusion in accordance with the present invention for an acoustic driver of an ink jet print head of the type illustrated in FIG. 3.

FIG. 7 shows a modified drive signal in accordance with the present invention for the acoustic driver of the same ink jet print head. Like the drive signal of FIG. 6, the modified drive signal of FIG. 7 consists of a refill pulse component, followed by a wait period and an ejection pulse component. In FIG. 7 the magnitude of the voltage of the refill pulse component is approximately 1.4 times the magnitude of the voltage of the ejection pulse component. The magnitude of the voltage of the refill pulse component of FIG. 7 is approximately 50 percent of the magnitude of the voltage shown for this pulse component in FIG. 6. In addition, the modified drive signal of FIG. 7 has greater ejection and refill pulse component time durations at these voltage amplitudes than those of the drive signal of FIG. 6. Further, the rise and the fall times for the refill pulse component and the ejection pulse component for the modified drive signal of FIG. 7 are approximately twice as long as the corresponding rise and fall times in FIG. 6. These particular modifications to the initial drive signal apply to obtain the preferred embodiment of the present invention, more specifically when the initial drive signal achieves high print quality at high printing rates in accordance with the parent patent application. Other modifications in accordance with the present invention would apply for other embodiments.

As described previously, the time duration for the refill pulse component and the wait period are chosen so that the frequency spectrum of the drive signal of FIG.

Figure 8A:
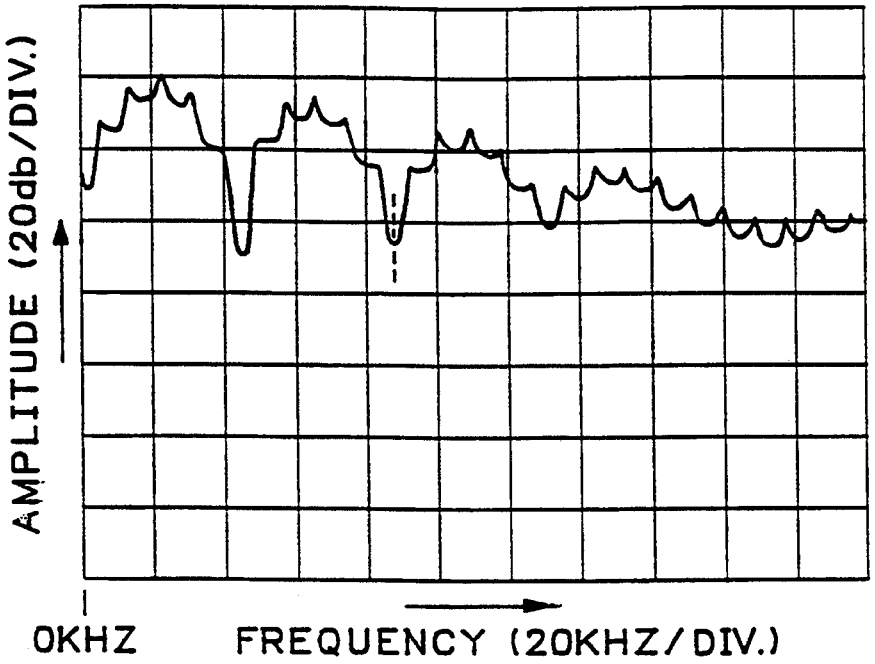
FIGS. 8*c* and 8*b* illustrates the frequency spectra of the drive signal in FIG. 6 and the drive signal in FIG. 7 with minimum energy for both drive signals occurring at about 85 kilohertz, the dominant acoustic resonant frequency of the ink jet print head.
Figure 8B:
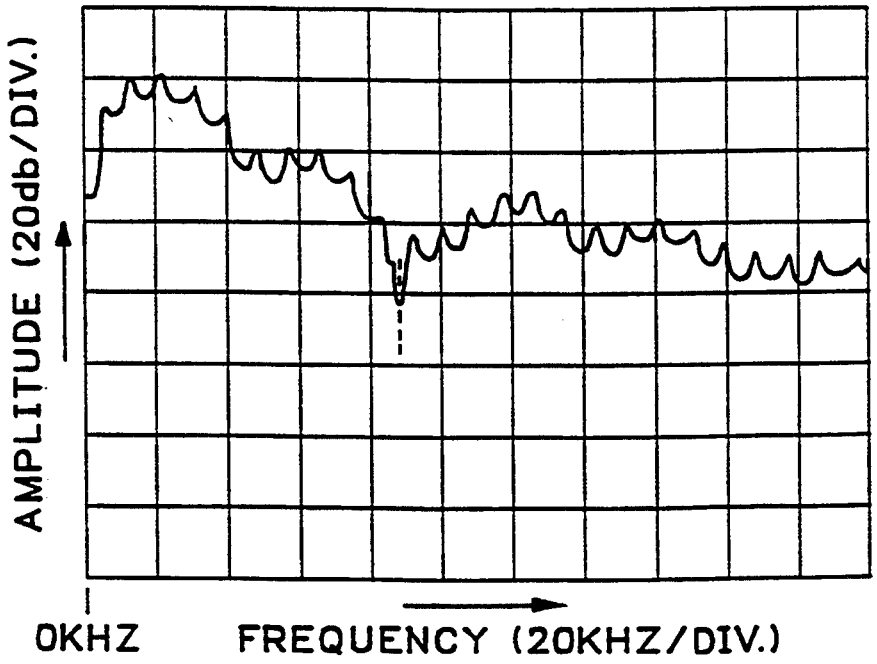

6 has minimum energy content at the dominant acoustic resonant frequency of the ink jet print head, in this case the standing wave resonant frequency through liquid ink in the offset channel of the ink jet print head. The same adjustment has been performed on the modified drive signal of FIG. 7. FIG. 8 compares the frequency spectra for the drive signal of FIG. 6 and the modified drive signal of FIG. 7. Both achieve minimum energy content at a frequency substantially equal to 85 kilohertz, the standing wave resonant frequency for the specific ink jet print head and the particular ink employed. For an ink jet print head utilizing air-saturated ink and the modified drive signal shown in FIG. 7 at an 8 kilohertz drop repetition rate, print quality degradation will not occur even after one hour and ten minutes of continuous ink jet print head operation. In contrast, print quality will degrade within 30 seconds of continuous operation for the same ink jet print head and the same air-saturated ink driven by the signal displayed in FIG. 6.

Figure 9:
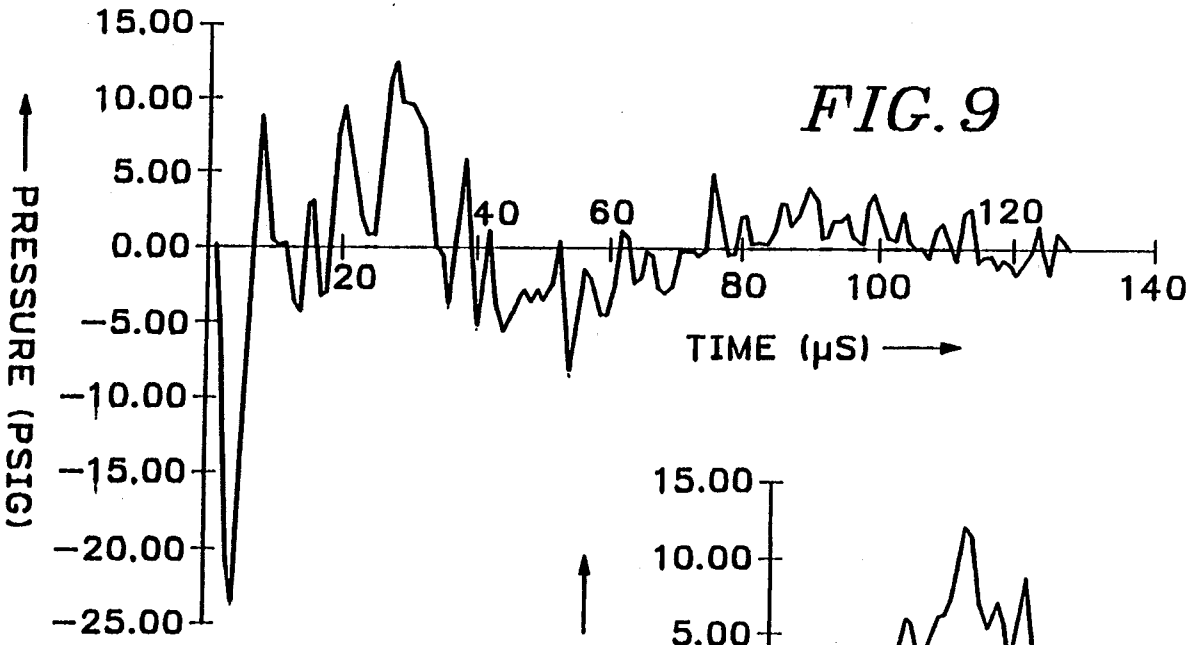
FIG. 9 is a time-based plot, for a theoretical model of an ink jet print head of the type illustrated in FIG. 3, of the pressure applied to ink residing within the ink pressure chamber of an ink jet print head operated by the drive signal of FIG. 6.
Figure 10:
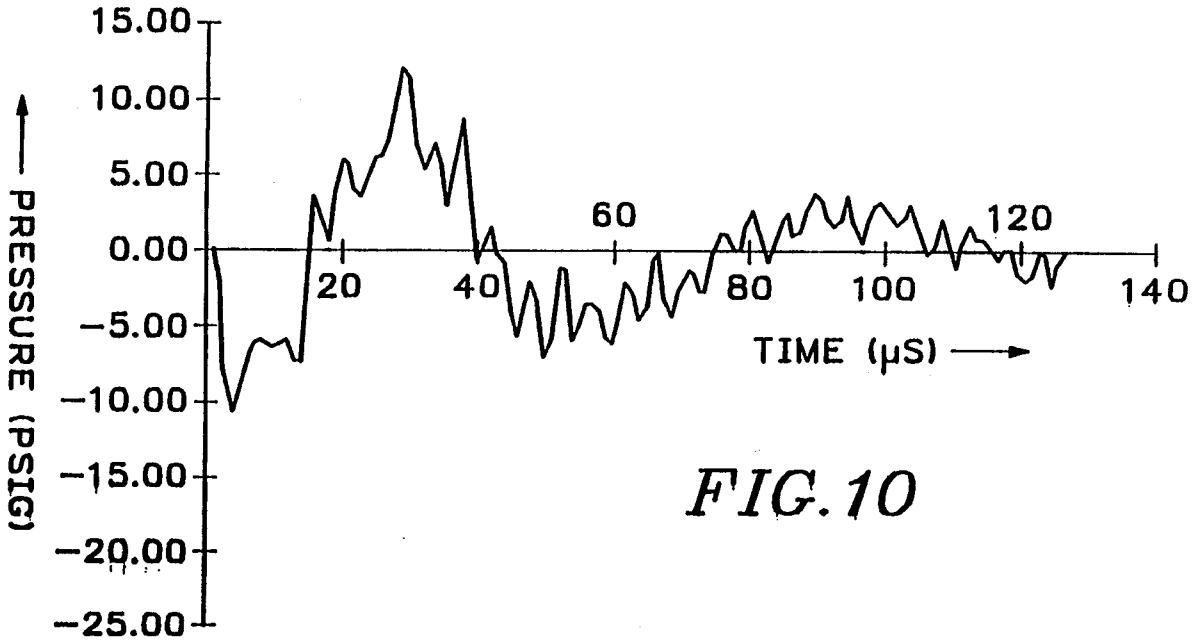
FIG. 10 is a time-based plot, for a theoretical model of an ink jet print head of the type illustrated in FIG. 3, of the pressure applied to ink residing within the ink pressure chamber of an ink jet print head operated by the drive signal of FIG. 7.

A theoretical model of ink jet print heads examines the pressure within the ink pressure chamber for a DOD ink jet print head of the type illustrated by FIG. 3. This theoretical model assumes a compressible fluid capable of withstanding fluid pressures below one atmosphere below ambient pressure. These pressures below atmospheric or ambient pressure are referred to as negative pressure. FIG. 9 is a plot of the pressure within the ink pressure chamber for the drive signal of FIG. 6 based upon this theoretical model. FIG. 10 is a plot of the pressure within the ink pressure chamber based upon the same model for the modified drive signal of FIG. 7. These theoretical model results presented in FIGS. 9 and 10 show the occurrence of pressures below ambient pressure within the ink pressure chamber resulting from the refill pulse component and occurring soon after the completion of the ejection pulse component for both drive signals. These pressures below atmospheric or ambient pressure are associated with rectified diffusion. The pressures that occur in the ink pressure chamber above atmospheric or ambient pressure do not cause rectified diffusion because such pressures have the effect of compressing or shrinking the air bubbles dissolved in the ink. According to the theoretical model, the refill pulse component of the modified drive signal displayed in FIG. 7 applies pressure below ambient pressure to the ink residing within the ink pressure chamber at less than half the magnitude of the pressure below ambient pressure applied by the refill pulse component of the drive signal of FIG. 6.

Figure 11:
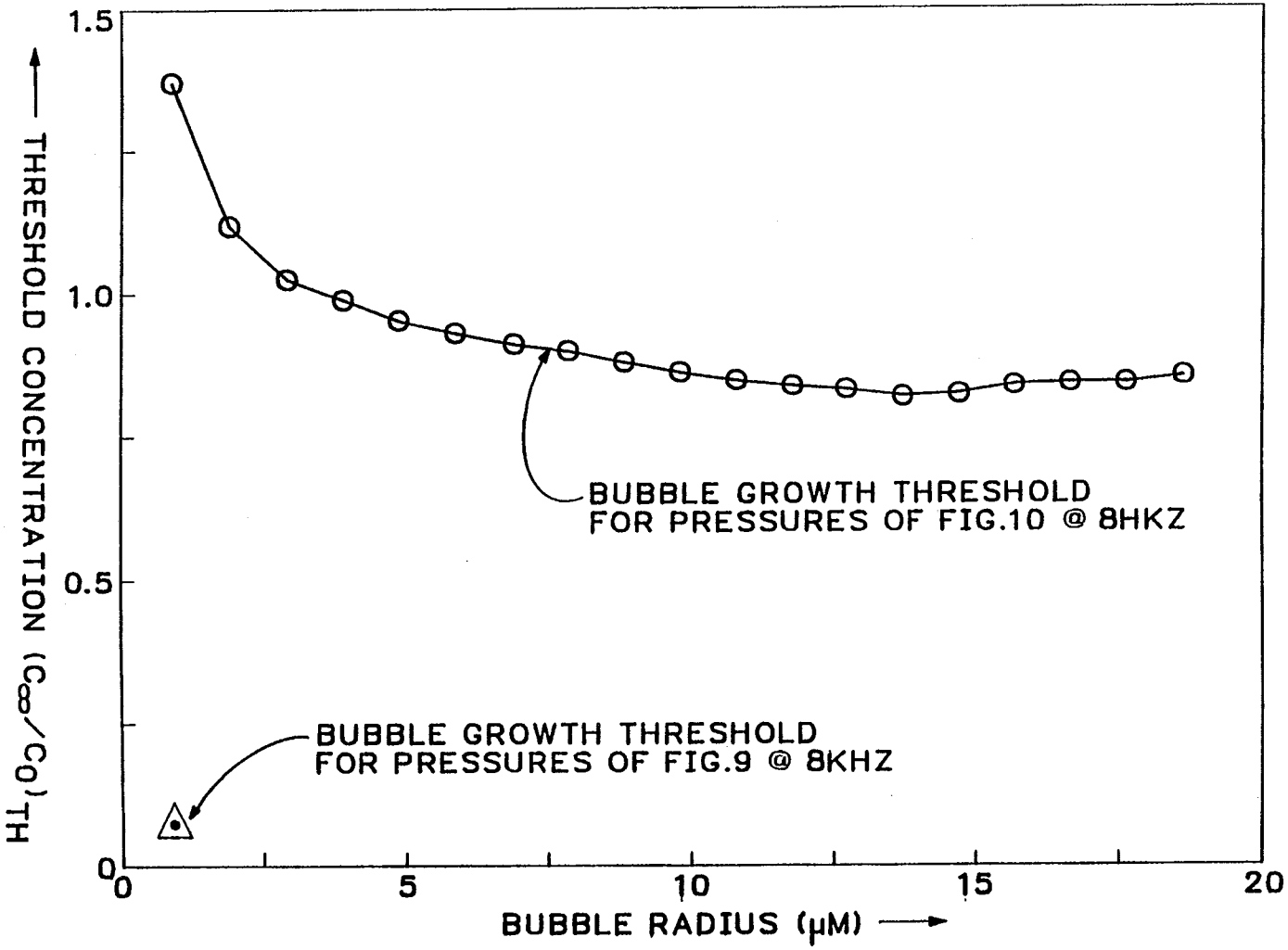
FIG. 11 is a plot, for a theoretical model of rectified diffusion, of the threshold concentration of air dissolved in ink for the onset of air bubble growth resulting from rectified diffusion versus air bubble radius, the threshold concentration of air being expressed as a Percentage of the saturation concentration of the ink.

A theoretical model of rectified diffusion investigates air bubble growth for a single air bubble immersed in a fluid. This theoretical model continuously applies a pressure pulse to the fluid. FIG. 11 shows theoretical model results for the drive signal of FIG. 6 and the modified drive signal of FIG. 7 repeated at a drop repetition rate of 8 kilohertz. It provides the threshold concentration of air dissolved in the ink, as a percentage of the ink's saturation concentration, for the onset of air bubble growth due to rectified diffusion for an air bubble of a given radius. According to the model, for ink having a concentration of dissolved air above 7 percent of the air saturation concentration of the ink, the drive signal of FIG. 6 applied at an 8 kilohertz drop repetition rate will cause air bubble growth for a bubble with a 1 micron radius. For the modified drive signal of FIG. 7, the threshold concentration for the onset of air bubble growth for a bubble with a 1 micron radius is 140 percent of the ink's saturation concentration.

The modified drive signal of FIG. 7 reduces the pressure below ambient pressure applied to the ink residing within the ink pressure chamber of the ink jet print head and thereby inhibits the growth of air bubbles dissolved in the ink and the associated print quality degradation. Particular embodiments of the modified drive signal may, however, also result in wetting the orifice outlet of the ink jet print head. Ink jet print head performance problems associated with wetting the orifice outlet are described above. Empirical results indicate that this wetting of the orifice outlet occurs when the magnitude of the voltage of the refill pulse component is less than 0.7 times the magnitude of the voltage of the ejection pulse component.

Finally, it should be noted that the present invention is applicable to ink jet print heads using a wide variety of inks. Inks that are liquid at room temperature, as well as inks of the phase change type which are solid at room temperature, may be used. One example of a suitable phase change ink is disclosed in U.S. Pat. No. 4,889,560, issued Dec. 26, 1989 and entitled, "Phase Change Ink Carrier Composition and Phase Change Ink Produced Therefrom."

Having illustrated and described the principles of the present invention with reference to its preferred embodiments, it will be apparent to those of ordinary skill in the art that the invention may be modified in arrangement and detail without departing from such principles. We claim as our invention all such modifications which fall within the scope of the following claims.

We claim:

1. In an ink jet print head of a type including an ink pressure chamber having an inlet coupled to a source of hot melt ink and an outlet coupled to an orifice, and a driver for controlling the volume of the ink pressure chamber in response to an electrical signal in order to eject an ink drop from the orifice, the ink pressure chamber further having air bubbles in the air saturated ink therein which experience a growth when pressure applied to the ink within the ink pressure chamber is repeatedly below ambient pressure and in negative pressure terms is greater than or equal to a threshold pressure amount of greater than about minus 10 psig at a repetition rate of about 8 Khz or grater, a method comprising applying a bipolar electrical signal to the driver in a manner to generate within said ink pressure chamber pressure waves in negative pressure terms that are characterized by being less than the threshold pressure amount thereby inhibiting growth of air bubbles therein.

2. The method according to claim 1 wherein the step of applying an electrical signal additionally comprises applying said signal in a manner that the pressure waves are generated within a print head passage at said pressure chamber inlet that inhibits growth of air bubbles within said inlet passage.

3. The method according to claim 1 wherein the step of applying an electrical signal additionally comprises applying said signal in a manner that the pressure waves are generated within a print head passage at said pressure chamber outlet that inhibits growth of air bubbles within said outlet passage.

4. The method according to claim 1 which additionally comprises, prior to the signal application step, a step of allowing ink within said pressure chamber to become substantially saturated with air.

5. The method according to claim 1 wherein the electrical signal applying step includes applying first and second pulses separated by a wait state.

6. The method according to claim 5 which additionally comprises, prior to the signal application step, a step of allowing ink within said pressure chamber to become substantially saturated with air.

7. The method according to claim 5 wherein the electrical signal applying step includes applying said first pulse with a polarity that expands the volume of the pressure chamber and applying said second pulse with a polarity that contracts the volume of the pressure chamber.

8. The method according to claim 7 wherein the electrical signal applying step includes applying said first pulse with a substantially exponentially rising leading edge and a substantially exponentially decaying trailing edge.

9. The method according to claim 7 wherein the electrical signal applying step includes applying said first pulse with a maximum amplitude that lies within a range of substantially 1.15 and 1.3 times a maximum magnitude of said second pulse.

10. The method according to claim 7 which additionally comprises, prior to the signal application step, a step of allowing ink within said pressure chamber to become substantially saturated with air.

11. The method according to claim 5 wherein the electrical signal applying step includes applying said first pulse with a finite rise time, a finite fall time and a given amplitude therebetween.

12. The method according to claim 5 wherein the electrical signal applying step includes applying said first pulse with a maximum amplitude that lies within a range of substantially 1.15 and 1.3 times a maximum magnitude of said second pulse.

13. In an ink jet print head of a type including an ink pressure chamber having an inlet coupled to a source of hot melt ink and an outlet coupled to an orifice, and a driver for controlling the volume of the ink pressure chamber in response to an electrical signal in order to eject an ink drop from the orifice, the ink pressure chamber further having air bubbles in the air saturated ink therein which experience a growth when pressure applied to the ink within the ink pressure chamber repeatedly is subambient pressure and in negative pressure terms is greater than or equal to a threshold pressure amount of greater than about minus 10 psig at a repetition rate of about 8 Khz or greater, a method comprising applying a bipolar electrical signal to the driver in a manner to generate within said ink pressure chamber sub-ambient pressure waves of a character that in negative pressure terms is less than the threshold pressure amount and thereby inhibits growth of air bubbles therein.

14. The method according to claim 13 wherein the step of applying an electrical signal additionally comprises applying said signal in a manner that the sub-ambient pressure waves are generated within a print head passage at said pressure chamber inlet that inhibits growth of air bubbles within said inlet passage.

15. The method according to claim 13 wherein the step of applying an electrical signal additionally comprises applying said signal in a manner that the sub-ambient pressure waves are generated within a print head passage at said pressure chamber outlet that inhibits growth of air bubbles within said outlet passage.

16. The method according to claim 13 which additionally comprises, prior to the signal application step, a step of allowing ink within said pressure chamber to become substantially saturated with air.

17. The method according to claim 13 wherein the electrical signal applying step includes applying first and second pulses separated by a wait state.

18. The method according to claim 17 which additionally comprises, prior to the signal application step, a step of allowing ink within said pressure chamber to become substantially saturated with air.

19. The method according to claim 17 wherein the electrical signal applying step includes applying said first pulse with a polarity that expands the volume of the pressure chamber and applying said second pulse with a polarity that contracts the volume of the pressure chamber, 20. The method according to claim 19 wherein the electrical signal applying step includes applying said first pulse with a substantially exponentially rising leading edge and a substantially exponentially decaying trailing edge.

21. The method according to claim 19 wherein the electrical signal applying step includes applying said first pulse with a maximum amplitude that lies within a range of substantially 1.15 and 1.3 times a maximum magnitude of said second pulse.

22. The method according to claim 19 which additionally comprises, prior to the signal application step, a step of allowing ink within said pressure chamber to become substantially saturated with air.

23. The method according to claim 17 wherein the electrical signal applying step includes applying said first pulse with a finite rise time, a finite fall time and a given amplitude therebetween.

24. The method according to claim 19 wherein the electrical signal applying step includes applying said first pulse with a maximum amplitude that lies within a range of substantially 1.15 and 1.3 times a maximum magnitude of said second pulse.

25. In a printer system including a print head of a type having an ink pressure chamber adapted to eject a liquid ink droplet on demand from an orifice to a print media upon altering the volume of said chamber in response to an electrical drive signal, a source of ink that is solid at an ambient operating temperature, and means melting said solid ink for supplying liquid ink to said head chamber, the liquid air saturated ink within the head chamber further having air bubbles therein which experience a growth when pressure applied to the ink within the head chamber is repeatedly less than ambient and is greater than or equal to a threshold pressure amount in negative pressure terms of greater than about minus 10 psig at a repetition rate of about 8 Khz or greater, a method of operating said printer system, comprising the steps of:

allowing the liquid ink within the head chamber to become substantially saturated with air, and causing the electrical drive signal to have an amplitude function including first and second pulses with a wait period of separation between the pulses, said amplitude function being adapted to generate within said head chamber ink pressure waves that apply a pressure to the liquid ink within the head chamber in negative pressure terms that is less than the threshold pressure amount and are characterized by inhibiting growth of air bubbles therein.

26. The method of claim 25 wherein the electrical drive signal is additionally caused to have its first and second pulses of opposite polarity.

27. The method of claim 25 wherein the first pulse of the electrical drive signal is caused to increase the chamber volume from a normal volume that exists without the electrical drive signal, and the second pulse of the electrical drive signal is caused to decrease the chamber volume from said normal volume.

28. The method of claim 27 wherein the second pulse is additionally caused to have a maximum magnitude that is less than a maximum magnitude of the first pulse.

29. The method of claim 27 wherein the first pulse is caused to have a maximum magnitude that is within a range of 1.15 and 1.3 times a maximum magnitude of said second pulse.

30. The method of claim 25 wherein the electrical signal is additionally caused to repeat at a rate of about 1000 times per second or more, thereby to eject a corresponding about 1000 or more droplets per second from said orifice.

31. The method of claim 25 wherein the electrical signal is additionally caused to repeat at a maximum controlled rate of 7000 times per second or more, thereby to eject a maximum of a corresponding 7000 droplets per second or more from the print head chamber orifice.

32. The method of claim 25 wherein the electrical drive signal is additionally caused to minimize its energy content in at least one frequency corresponding to at least one acoustic resonant frequency of said print head.

* * * * *